US009475201B2

(12) United States Patent
Georgakis et al.

(10) Patent No.: US 9,475,201 B2
(45) Date of Patent: Oct. 25, 2016

(54) SHAVING BLADE CARTRIDGE

(71) Applicant: BIC-Violex SA, Anixi, Attiki (GR)

(72) Inventors: Georgios Georgakis, Melisia (GR); Dimitrios Efthimiadis, Nea Kypseli (GR)

(73) Assignee: BIC-VOLEX SA, Attiki (GR)

( * ) Notice: Subject to any disclaimer, the term of this patent is extended or adjusted under 35 U.S.C. 154(b) by 0 days.

(21) Appl. No.: 14/037,863

(22) Filed: Sep. 26, 2013

(65) Prior Publication Data

US 2015/0082638 A1 Mar. 26, 2015

(30) Foreign Application Priority Data

Sep. 25, 2013 (EP) ..... 13185994

(51) Int. Cl.
*B26B 21/22* (2006.01)
*B26B 21/40* (2006.01)

(52) U.S. Cl.
CPC ..... *B26B 21/222* (2013.01); *B26B 21/4018* (2013.01); *B26B 21/4068* (2013.01); *B26B 21/4075* (2013.01)

(58) Field of Classification Search
CPC ..... B26B 21/4012; B26B 21/4068; B26B 21/222; B26B 21/40; B26B 21/4018; B26B 21/4025
USPC ..... 30/47–51
See application file for complete search history.

(56) References Cited

U.S. PATENT DOCUMENTS 4,270,268 A * 6/1981 Jacobson ..... 30/47
4,403,412 A * 9/1983 Trotta ..... B26B 21/227 30/47
5,092,042 A * 3/1992 Miller ..... B26B 21/4031 30/34.2
5,224,267 A * 7/1993 Simms et al. ..... 30/50
5,761,814 A * 6/1998 Anderson et al. ..... 30/50
5,813,293 A * 9/1998 Apprille et al. ..... 76/106
5,822,862 A * 10/1998 Ferraro ..... B26B 21/227 30/47
6,035,537 A * 3/2000 Apprille et al. ..... 30/346.5
6,305,084 B1 * 10/2001 Zucker ..... B26B 21/22 30/47
7,681,320 B2 * 3/2010 Szczepanowski et al. ..... 30/530
8,782,903 B2 * 7/2014 Clarke ..... B26B 21/4018 30/34.1
2004/0103538 A1 * 6/2004 Dansreau ..... B26B 21/222 30/34.2
2005/0198840 A1 * 9/2005 Worrick et al. ..... 30/527
2015/0090085 A1 * 4/2015 Griffin ..... B26B 21/4018 83/13

* cited by examiner

*Primary Examiner* — Jason Daniel Prone
*Assistant Examiner* — Richard Crosby, Jr.
(74) *Attorney, Agent, or Firm* — Polsinelli PC

(57) ABSTRACT

A shaving blade cartridge including a housing extending along a longitudinal axis (X-X), having first and second longitudinal sides, and being provided with a through hole extending transversally to the longitudinal axis through the housing. The shaving blade cartridge also includes at least one cutting blade and a clip retaining the at least one cutting blade in the housing and having a first leg, a second leg, and a clip body. The shaving blade cartridge is such that the first leg of the clip surrounds the first longitudinal side, and the second leg of the clip is received in the through hole.

17 Claims, 5 Drawing Sheets

SHAVING BLADE CARTRIDGE

CROSS-REFERENCE TO RELATED APPLICATIONS

This application claims priority to European Application No. EP13185994.4 filed on Sep. 25, 2013, the entire contents of this application are incorporated herein by reference.

FIELD OF THE INVENTION

The embodiments of the present invention relate to shaving blade cartridges and shavers having such shaving blade cartridges.

BACKGROUND OF THE INVENTION

In particular, the embodiments of present invention are related to a shaving blade cartridge that includes a housing extending along a longitudinal axis, having a top side, a bottom side opposite to the top side, and first and second longitudinal sides, each extending longitudinally along the longitudinal axis between the top and bottom sides, the housing being provided with a through hole extending transversally to the longitudinal axis through the housing between the top side and the bottom side, at least one cutting blade mounted in the housing between the first and second longitudinal sides, and having a cutting edge extending along the longitudinal axis, a clip retaining the at least one cutting blade in the housing and having a first leg, a second leg and a clip body extending between the first and second legs.

The through hole of the housing is an aperture which passes through the housing from the top side of the housing to the bottom side of the housing and which is completely surrounded by material when viewed from the top side or from a cross-section.

U.S. Pat. No. 8,286,354 discloses a razor having two clips, each clip comprising a pair of legs that extend through a pair of through holes provided in the housing. The two pairs of through holes in the housing require important structural modifications of the housing of known cartridges. Moreover, the assembly of the clip can be difficult. Indeed, during the manufacturing process, both legs of the clip have to be in correspondence with two different through holes, which requires strict tolerances to be applied to the clip and to the through holes. The embodiments of the present invention disclosed in this application are clearly distinguishable from U.S. Pat. No. 8,286,354, which requires two pairs of apertures extending through the housing from the top surface to the bottom surface, with each pair of apertures having one aperture in front of the cutting edge and one aperture behind the cutting edge, and a pair of spaced apart clips each having a pair of legs extending through the corresponding pair of apertures. The embodiments of the present invention require only one through hole on each side of the blade assembly for one leg of the clip to go through; the second leg of the clip goes around the cartridge body.

U.S. Pat. No. 4,270,268 describes a cartridge having a clip retaining at least a blade. The clip disclosed in U.S. Pat. No. 4,270,268 surrounds the housing and is received at least in grooves provided in the housing. The installation of such clip is easy, since it surrounds the housing. However, such clip is easily movable and can unintentionally be removed by a user during shaving. Indeed, when the clips are removed, the blades are not retained in the housing resulting in their free movement.

Various solutions have been used in order to avoid such drawbacks.

WO9610473 discloses a cartridge having a clip which is wrapped around the housing. Means are disposed adjacent to end portions of the clip. The means inhibit movement of the clip end portions relative to the housing in a direction transverse to the longitudinal direction of the blade to prevent separation of the end portions of the clip one from another. Such means are an improvement. However, the risk of unintentionally removing the clip still exists. Moreover, the assembly of such clip can be difficult, since the inhibiting means have to match with complementary portions on the housing.

WO9717174 discloses a razor cartridge with a clip being forced through two openings. More particularly, each leg of the clip extends through an opening in the shaving blade cartridge. This arrangement enables the clip to be kept firmly in place. However, it also necessitates various requirements regarding mounting and requires important structural modifications of the housing of known cartridges.

To avoid a complicated assembly, WO9955499 discloses a cartridge having an annular clip with two legs which cooperate with two recesses in the housing in order to retain the clip.

However, the annular clip lowers the shaving surface, which is the active surface during the shaving.

The embodiments of the present invention have objectives to mitigate the drawbacks discussed above.

SUMMARY OF THE INVENTION

To this aim, according to an embodiment of the present invention, such a shaving blade cartridge includes a first leg of the clip that surrounds a first longitudinal side and at least a portion of the bottom side of the housing, and a second leg of the clip received in a through hole.

With these features, the blades are retained in the housing in a secure way, without lowering the shaving surface (also called shaving window). The leg of the clips received in the through hole enables the clip to be securely maintained in the housing. The leg of the clip surrounding the housing enables an easy assembly of the clip. The clip provided to retain the blades does not require any important structural modification of the existing housing and is easily assembled to the housing without causing stress to the clips which could cause the clip to not withstand the forces encountered during shaving.

In some embodiments, a person of ordinary skill in the art might also use one or more of the following features:

- the clip body extends along a transversal axis, the transversal axis being orthogonal to the longitudinal axis, and the clip body being arranged facing the top side of the blade cartridge;
- the position of the clip enables a large shaving surface, to produce an esthetical cartridge, and the clip is easy to assemble;
- the second leg of the clip is bent about at least a portion of the bottom side; the bent portion provides a second maintaining area of the clip, which leads to a robust assembly and minimizes the risk of unintentional disassembly of the clip;
- the first leg of the clip comprises a hook, the bottom side of the housing comprises a recess, and the hook cooperates with the recess; the hook and the recess cooperate together to provide the retaining of the first leg of the clip to the housing;

the bottom side comprises a fulcrum portion extending outward beyond adjacent surface portions on one side of the fulcrum portion, and where one of the first and second legs of the clip has a portion which is bent over the fulcrum portion; the fulcrum portion enables the leg of the clip to be bent easily and to retain the clip;

the bottom side comprises a first and second fulcrum portion, each fulcrum portion extending outward beyond adjacent surface portions on one side of the fulcrum portion, the first leg of the clip being bent over the first fulcrum portion, and the second leg of the clip being bent over the second fulcrum portion; the fulcrum portion enables the leg of the clip to be bent;

the housing defines a cut-out, the first leg of the clip surrounding the cut-out; the clip does not project beyond the housing (in other words, the clip is totally integrated to the housing), which provides shaving without discomfort;

the housing comprises a guard bar and a rear cap, the guard bar being forward of the blade edge and the rear cap being rearward of the blade edge, and where the through hole is arranged in or adjacent to the guard bar; the guard bar can, for example, be manufactured directly with the through hole;

the first leg of the clip surrounds the first longitudinal side of the housing rearward of the blade edge;

the housing comprises a guard bar and a rear cap, the guard bar being forward of the blade edge and the rear cap being rearward of the blade edge, and the through hole is arranged in or adjacent to the rear cap;

the shaving blade cartridge is provided with a second clip retaining the at least one cutting blade in the housing, the second clip having a first leg, a second leg and a clip body extending between the first and second legs, and the second leg of the second clip is received in a second through hole provided in the housing and extending through the housing between the top side and the bottom side, and the first leg of the second clip surrounds the first longitudinal side of the housing and at least a portion of the bottom side of the housing; both clips retain the blades in the housing;

the rear cap comprises a shaving aid member, the shaving aid member extending along the longitudinal axis and being smaller in length than the cutting blade, and where the shaving aid member extends between the two clips; the clips do not limit the active surface of the shaving aid;

the guard bar extends along the longitudinal axis, the guard bar being smaller in length than the cutting blade, and where the guard bar preferably extends between the two clips; the clips do not limit the active surface of the guard bar.

the bottom side of the housing comprises a protrusion, which extends between a first and a second end of the clip; this protrusion prevents the assembly machine from disassembling the clip by mistake while retreating. The protrusion makes the disassembly more difficult.

The embodiments of the present invention are also directed to a shaver comprising a handle and a shaving blade cartridge as described above, the shaving blade cartridge being connected to the handle.

BRIEF DESCRIPTION OF THE DRAWINGS

Other characteristics and advantages of the embodiments of the present invention will readily appear from the following description of one of its embodiments, provided as non-limitative examples, and shown in the accompanying drawings.

On the Drawings.

On the different figures, the same reference signs designate like or similar elements.

DETAILED DESCRIPTION

Figure 1:
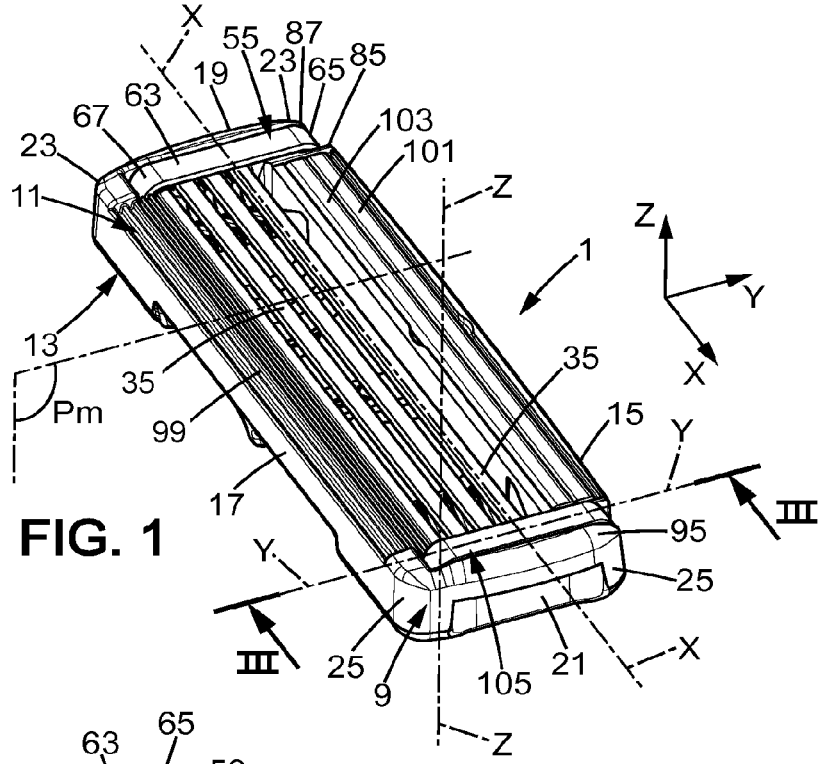
FIG. 1 is a perspective view of a shaving blade cartridge according to an embodiment of the present invention, the cartridge comprising a housing, three blades and two clips retaining the blades in the housing.

FIG. 1 shows a shaving blade cartridge 1 of a wet razor, the blades 35 of which are not driven by a motor relative to the shaving blade cartridge.

Figure 7:
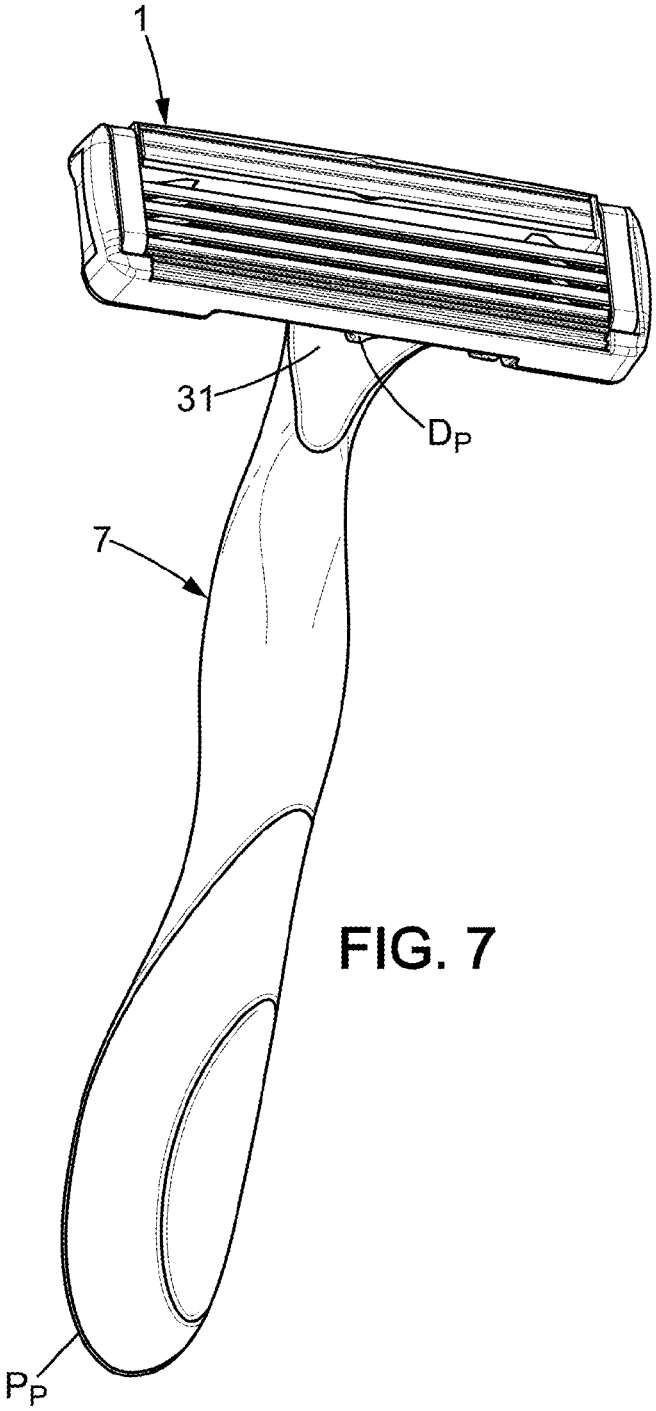
FIG. 7 shows a perspective view of a shaver comprising a handle and a cartridge, according to the present invention.

As shown on FIG. 7, the shaving blade cartridge 1 is attached to a handle 7 extending in a handle direction between a proximal portion Pp and a distal portion Dp. The handle 7 can pivot with regard to the shaving blade cartridge 1. In other embodiments, the handle may also be fixed with regard to the shaving cartridge. The handle direction may be curved or include one or several straight portions. The shaving blade cartridge 1 can, for example, be releasably connected to the shaver handle 7 through a lock-and-release mechanism.

Figure 2:
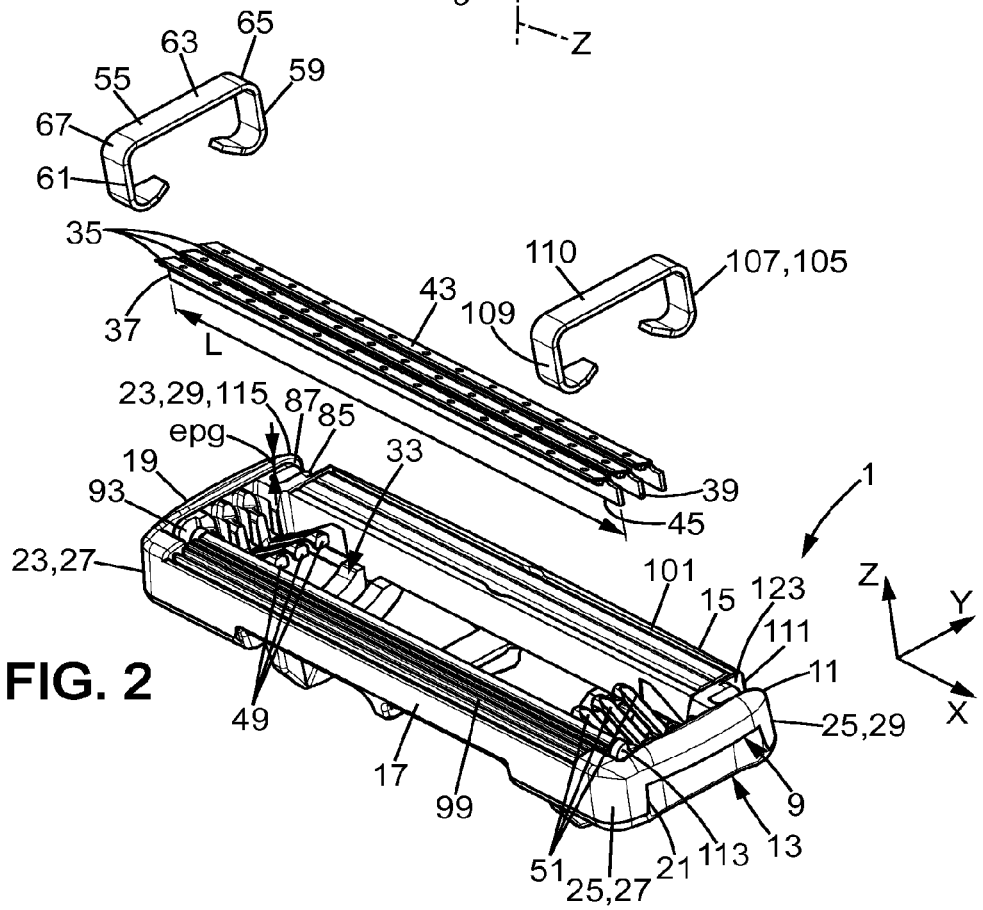
FIG. 2 is an exploded perspective view of the shaving blade cartridge of FIG. 1.
Figure 3:
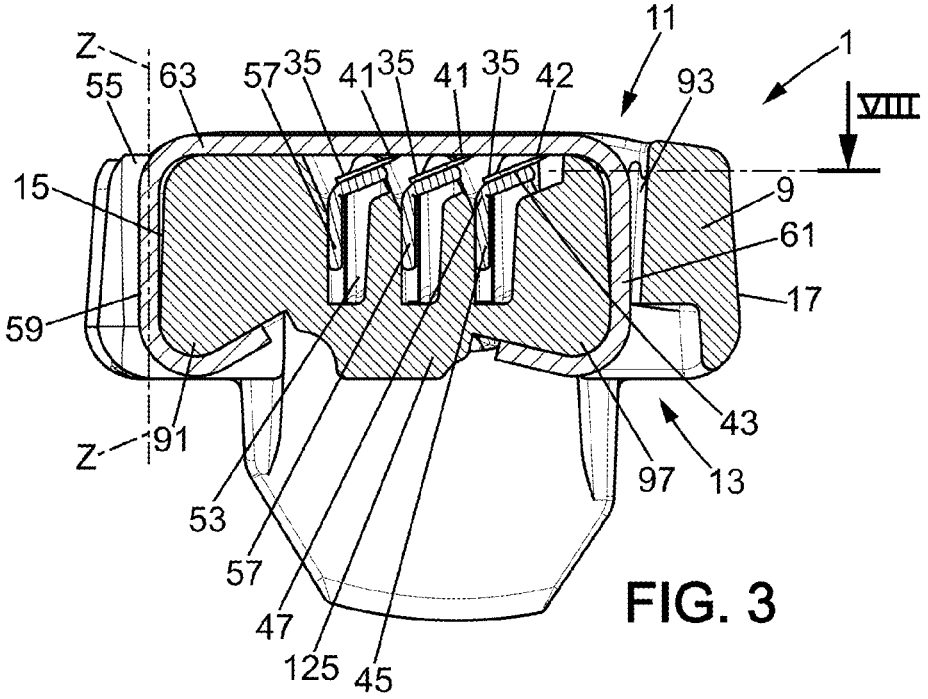
FIG. 3 is a lateral view of the shaving blade cartridge of FIG. 1.

As depicted on FIGS. 1, 2 and 3, the shaving blade cartridge 1 comprises a housing 9. The housing 9 extends along a longitudinal axis X-X. Viewed from the top, the housing 9 has a rectangular general shape. However, in some embodiments, the shape of the housing 9 may be different, e.g., the housing 9 could have an oval shape. The housing 9 includes a top side 11, a bottom side 13 opposite to the top side 11 and a first and second longitudinal side 15, 17. For example, the bottom side 13 is adapted to be arranged in front of the handle 7 whereas the top side 11 is arranged opposite to the handle 7. The top side 11 and the bottom side 13 can be parallel to each other. The first longitudinal side 15 extends along the longitudinal axis X-X. The second longitudinal side 17 and the first longitudinal side 15 are facing each other. The second longitudinal side 17 may be approximately parallel to the first longitudinal side 15, especially when the first and second longitudinal sides 15, 17 are flat. The second longitudinal side 17 also extends along the longitudinal axis X-X. The first and the second longitudinal side 15, 17 each extend in a lateral direction Z along a lateral axis Z-Z, between the top side 11 and the bottom side 13 of the housing 9. The first side 15 can be forward or rearward of the blade edges according to the embodiment.

The housing 9 may also comprise, as best shown in FIG. 2, first and second lateral sides which extend between the first and second longitudinal sides 19, 21, along a transversal axis Y-Y, the transversal axis Y-Y being, for example, orthogonal to the longitudinal axis X-X and to the lateral axis Z-Z. The first and second lateral sides 19, 21 are arranged, in the lateral direction Z, between the top side 11 and the bottom side 13. The first and second lateral and longitudinal sides 15, 17, 19, 21 together form the external surface of the housing 9. The first and second lateral sides 19, 21 both join the longitudinal ends 23, 25 of the first and second longitudinal sides 15, 17. In a similar way, the first and second longitudinal sides 15, 17 both join the free ends 27, 29 of the first and second lateral sides 19, 21.

The housing 9 can be made of plastic material. However, other materials may be used. The housing 9 can for example include, on the bottom side 13, a connection mechanism 31 adapted to connect the handle 7. The connection mechanism 31 can thus allow the release and/or the attachment of the shaving blade cartridge 1 to the handle 7.

The housing 9 also comprises a blade receiving section 33, as best shown in FIG. 2. The blade receiving section 33 or blade receiving area preferably has a general rectangular shape. The blade receiving section 33 is arranged on the top side 11 of the housing 9. The blade receiving section 33 defines a recess and is adapted to receive at least one cutting blade 35. In other words, the shaving blade cartridge 1 includes at least one cutting blade 35 (also called blade in the rest of the description). As shown on FIGS. 1, 2, 3 and 6, the shaving blade cartridge 1 includes three cutting blades 35. However, in other embodiments, the shaving blade cartridge 1 can include less than or more than three cutting blades 35, for example the shaving blade cartridge 1 includes five cutting blades 35, as shown on FIG. 4. The description below is made with reference to figures representing the shaving blade cartridge 1 including three or five cutting blades 35. However, as previously mentioned, the number of cutting blades may be different.

The blades 35 are mounted in the housing 9 in the blade receiving section 33 between the first and second longitudinal sides 15, 17 of the housing and between the first and second lateral sides 19, 21 of the housing 9. As shown in FIGS. 1, 2, 3 and 6 each blade 35 extends longitudinally along the longitudinal axis X-X. Each cutting blade 35 includes a first and second end 37, 39 along the longitudinal axis X-X. The first end 37 of the cutting blades 35 is directed toward the first lateral side 19 of the housing 9, whereas the second end 39 of the cutting blade 35 is directed toward the second lateral side 21 of the housing 9. Each cutting blade 35 includes a cutting edge 41. The cutting edge 41 extends along the longitudinal axis X-X. The cutting edge 41 of the cutting blade 35 is accessible at the top side 11 of the housing 9 to cut hair during shaving.

For example, the cutting blades 35 are L-shaped as shown in FIG. 3. The cutting blades 35 thus have a cutting edge portion 43, a guided portion 45, and a bent portion 47 which is intermediate to the cutting edge portion 43 and the guided portion 45. The cutting edge portion 43 extends along a cutting edge portion axis. Advantageously, the cutting edge portion axis of all cutting blades 35 are positioned parallel to each other.

In an embodiment of the present invention, each cutting blade 35 is freely mounted in the housing 9, as best shown on FIG. 2. More precisely, the blades 35 are movably mounted in the blade receiving section 33. Each cutting blade 35 is, for example, borne (or carried) by two elastic fingers 49, 51. The elastic fingers 49, 51 can be molded as a single piece with the housing 9 and can extend in the blade receiving section 33 towards each other and upwardly from both lateral sides 19, 21 of the housing 9. As shown on FIG. 3, the guided portions 45 of the cutting blades 35 are slidingly guided in slots 53 provided in the housing 9. For example, the cutting blade 35 can be supported by having its cutting edge 41 fixed on a blade support 57 which includes the guided portion 45 and the bent portion 47. In this case the blade support 57 is carried by the elastic fingers 49, 51.

However, in some others embodiments (not shown on the figures) the blades could be bent blades, as described for instance in patent application WO 2013/050606.

Each cutting blade 35 is retained in the housing by a clip 55.

Figure 5:
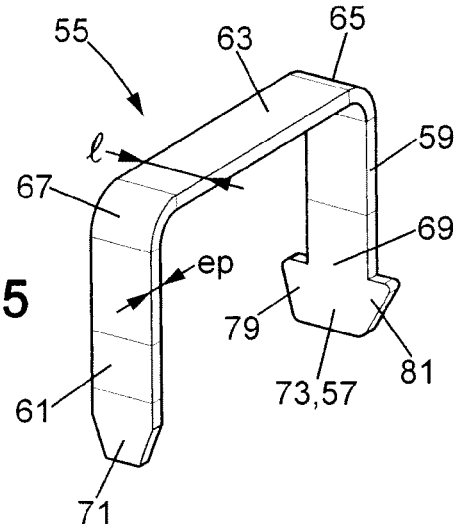
FIG. 5 is a perspective view of the clip of FIG. 4.

The clip 55, as shown on FIG. 5, includes a first leg 59, a second leg 61 and a clip body 63. The clip body 63 includes a first and a second end 65, 67. The first leg 59 of the clip 55 extends the first end 65 of the clip body 63 whereas the second leg 61 of the clip 55 extends the second end 67 of the clip body 63. The clip body 63, first leg 59 and second leg 61 form a one-piece part.

FIG. 5 shows the clip 55 before being mounted on the housing 9. The clip 55 comprises a first and second end 69, 71. The first end 69 of the clip 55 is provided on the first leg 59. The second end 71 of the clip 55 is provided on the second leg 61. In other words, each leg 59, 61 extends to an end 69, 71. Before being mounted, the clip 55 is preferably U-shaped. It is made of a formable material, for example a thin sheet of suitable metal. However, other materials may be considered. The width "1" of the clip is preferably sensibly constant along its length. Moreover, as shown on FIG. 5, the thickness "ep" of the clip 55 is preferably constant along its length. In others embodiments, the width "1" and the thickness "ep" of the clip could vary. Although not shown on the figures, an underside of the clip 55 between the first end 65 and second end 67 may include angled grooves in the clip with defined angles with respect to the edges of the angled blades for receiving and contacting the blade edge to ensure a more secure connection between the clip 55 and blades. In the embodiments of the present invention, the edge of the blades come into contact at least with the underside of the clip.

As shown on the FIGS. 1 to 4 and 6 to 7, when being mounted, the first leg 59 of the clip 55 surrounds the first longitudinal side 15 of the housing 9 and at least a portion of the bottom side 13 of the housing 9. In other words, a portion of the clip 55 is wrapped around a portion of the housing 9.

Figure 4:
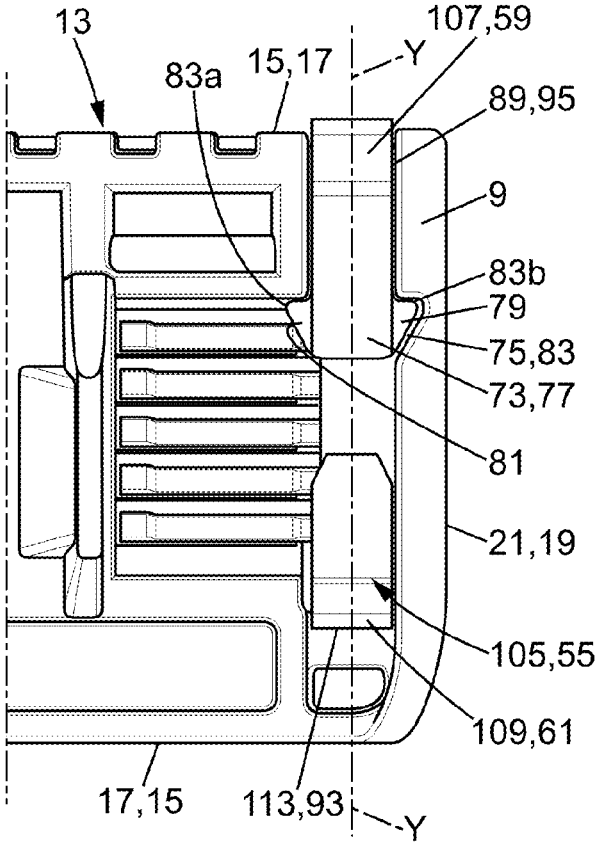
FIG. 4 is a rear view of a shaving blade cartridge according to an embodiment of the present invention, the shaving blade cartridge comprising five blades.

In another embodiment, as shown on FIG. 4, the first leg 59 of the clip 55 includes retaining means 73 adapted to cooperate with complementary means 75 provided on the housing 9 in order to avoid any movement of the first leg 59 with regard to the housing 9. As best shown on FIG. 4, for example, the first leg 59 of the clip 55 includes a hook 77. The hook 77 can be provided at the first end 69 of the first leg 59. As shown, the hook 77 includes two anchoring portions 79, 81 extending on both sides of the first leg 59 of the clip 55. Each anchoring portion 79, 81 cooperates with a complementary portion arranged on the bottom side 13 of the housing 9. The bottom side 13 of the housing 9 includes for example a recess 83, which forms the complementary means 75. Thus, the hook 77 cooperates with the recess 83. More precisely, the recess 83 includes two parts 83*a*, 83*b*, each part receiving one of the anchoring portions 79, 81.

Figure 6A:
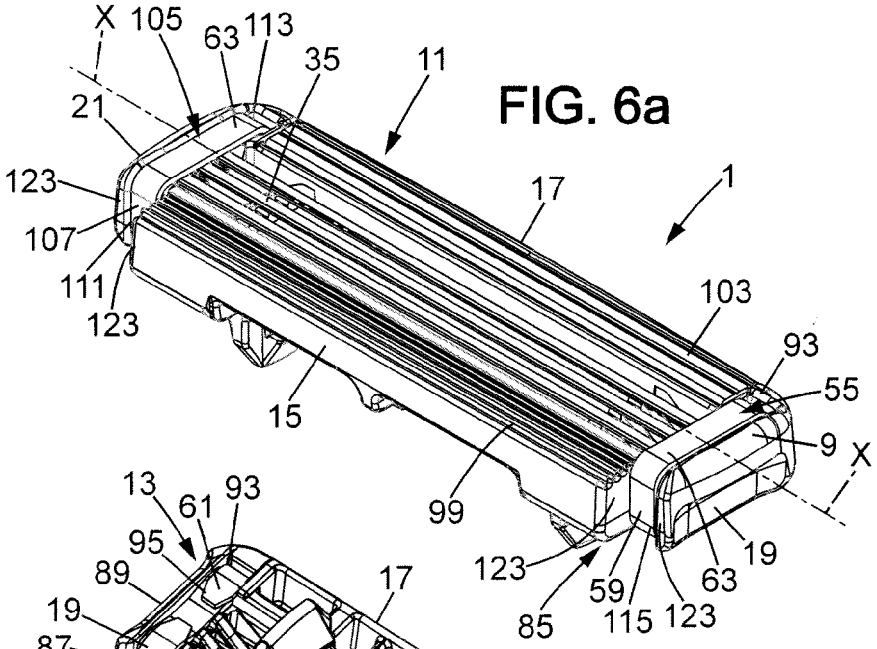
FIGS. 6*a* and 6*b* are perspective views of a shaving blade cartridge according to a second embodiment of the present invention.
Figure 6B:
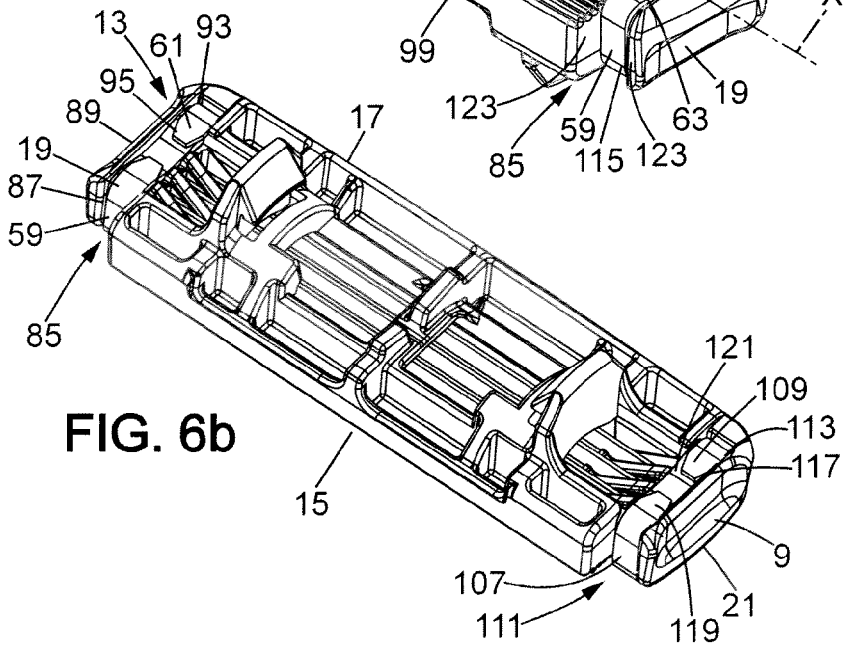

The first longitudinal side 15 can be provided with a cut-out 85 or notch, as shown on FIG. 6*a* and FIG. 6*b*. The first leg 59 of the clip 55 surrounds the cut-out 85. The cut-out 85 is a recess which is provided at a lateral edge of the housing. The cut-out defines a shoulder 123 in the housing. More precisely, as shown , the cut-out 85 passes around the housing 9 and is arranged at a common edge of the first longitudinal side 15 and the first and/or second lateral side 19, 21. The first leg 59 of the clip 55, which is bent around the cut-out, extends in an embodiment on the bottom side of the housing 13 and can be provided with the hook 77.

Alternatively or in addition to the cut-out 85, the first longitudinal side 15 can be provided with a groove 87, as shown on FIG. 2. The groove 87 preferably is a narrow furrow or channel which extends on or around the housing without passing through the housing, i.e., the groove is not an aperture. More precisely, the groove 87 is arranged in a wall of the cut-out 85. The first leg 59 of the clip 55 surrounds the first longitudinal side 15 by extending in the groove 87. In other words, the first leg 59 of the clip 55 is received in the groove 87.

The width of the housing from the first longitudinal side 15 to the second longitudinal side 17 from the cap member to the guard member is greater than the width between the longitudinal groove 87 and the second longitudinal side 17. In other words, as shown on FIG. 2, the first longitudinal side 15 extends further widthwise than the edge of the longitudinal groove 87 thereby creating the cut-out section 85 described above.

The bottom side 13 of the housing 9 can also be provided with a groove 89, which extends the groove 87 of the first longitudinal side 15. The first leg 59 of the clip 55 extends in the groove 89 of the bottom side. The thickness epg of the groove 87, 89 can be the same as the thickness "ep" of the clip 55. Thus, the first leg 59 of the clip 55 does not protrude outside of the housing 9 from the groove 87, 89.

As shown on FIG. 3, the bottom side 13 of the housing 9 can comprise a protruding portion, more precisely a fulcrum portion 91. The fulcrum portion 91 extends outward beyond adjacent surface portions on one side of the fulcrum portion 91. The first leg 59 of the clip 55 has a portion which is bent over the fulcrum portion 91, as shown on FIG. 3.

The clip body 63 is arranged facing the top side 11 of the shaving blade cartridge 1. More precisely, the clip body 63 is facing the cutting edge 41 of the at least one cutting blade 35. In order to avoid any interference with the shaving, the clip body 63 is arranged towards one of the longitudinal ends 37, 39 of the cutting blade 35. The clip body 63 extends along the transversal axis Y-Y in its mounted position.

Figure 8A:
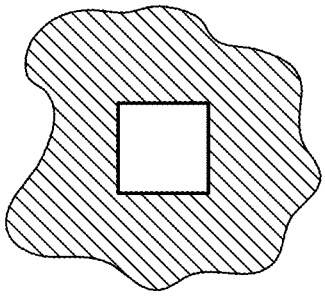
FIGS. 8*a* to 8*c* show schematic sectional views along the VIII axis shown on FIG. 3 of through hole which can be provided on the housing respectively with a square section, a rectangular section and a circular section.
Figure 8B:
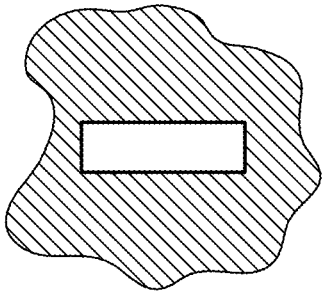
Figure 8C:
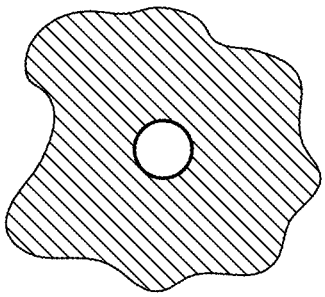

The second leg 61 of the clip 55 is received in a through hole 93 provided in the housing 9. The through hole 93 extends transversally to the longitudinal axis X-X along the lateral axis Z-Z through the housing 9 between the top side 11 and the bottom side 13. The through hole 93 is neither a slot nor a groove. The through hole 93 extends through the housing 9 and when viewed in transversal cross-sectional view is laterally surrounded by the housing's material. As shown on FIGS. 8*a* and 8*c*, the through hole may have a circular or square shape. The through hole 93 can also have a rectangular shape section, as shown on FIG. 1 and on FIG. 8*b*. The section of the through hole can be constant over the entire length of the through hole in the lateral direction Z-Z. However, in some embodiments, the section of the through hole 93 may vary over its length along the lateral axis Z-Z. As shown on FIG. 3, the dimension along the transversal axis Y-Y of the through hole can decrease from the top side 11 of the housing to the bottom side 13 of the housing 9. The walls defining the through hole 93 may be straight, in order to facilitate the mounting of the second leg 61 of the clip 55 in the hole. In addition, the walls may be orthogonal to the shaving plane, which is the plane defined as being the plane passing through the surfaces of the housing directly located forward of the cutting blade edge and rearward of the cutting blade edge. In another embodiment, the walls are angled with regard to the shaving plane. For example, the angle between the walls and the shaving plane may be between 70° and 100°.

The shape of the clip 55, and more particularly of the second leg 61, is complementary to the shape of the through hole 93 and can be different from the shape described above with reference to FIG. 5. Viewed in a transversal section, the shape of the clip can be rectangular, square, or oval. The longitudinal axis X-X and the lateral axis Z-Z are preferably orthogonal. The through hole 93 is, as shown on FIGS. 1, 2, 3, 4 and 6, separated from the blade receiving section 33. For example, the through hole 93 is arranged near the first lateral side 19 and/or near the second longitudinal side 17. More precisely, the through hole 93 is arranged between the second longitudinal side 17 and the blade receiving section 33.

The second leg 61 of the clip 55, which is received in the through hole 93, is bent around at least a portion of the bottom side 13, as shown on FIGS. 3 and 4. The second leg 61 of the clip 55 can extend in a groove 95 provided on the bottom side 13 of the housing 9. For example, the groove 95 for the second leg 61 is in the continuity of the groove(s) 87, 89 for the first leg 59.

The bottom side 13 of the housing 9 can comprise a second fulcrum portion 97 (or protruding portion). The second fulcrum portion 97 extends outward beyond adjacent surface portions on one side of the second fulcrum portion 97. The second leg 61 of the clip 55 has a portion which is bent over the second fulcrum portion 97, as shown in FIG. 3.

The second end 71 of the clip 55, corresponding to the free end of the second leg 61, is preferably tapered (preferably V-shaped).

The housing 9 preferably can comprise a guard bar 99 and a rear cap 101. The guard bar 99 is forward of the cutting edge 41. The guard bar 99 is located in front of the cutting edges 41. The rear cap 101 is located rearward of the cutting edge 41. In other words, the rear cap 101 is behind the cutting edge 41.

The rear cap 101 is preferably provided with a lubricating strip. In other words, the rear cap 101 preferably comprises, as shown in FIG. 1, a shaving aid member 103. The shaving aid member 103 extends along the longitudinal axis X-X. The shaving aid member 103 preferably has the same length in the longitudinal direction X than the rear cap 101, or is smaller in length than the rear cap 101.

As shown in FIGS. 1-3 and 6, the shaving blade cartridge 1 comprises a second clip 105. The second clip 105 is identical to the first clip 55. In others embodiments, the second clip 105 may be different from the first clip. The first clip 55 is arranged near the first longitudinal end 23 of the at least one cutting blade 35 whereas the second clip is arranged near the second longitudinal end 25 of the at least one cutting blade 35. The distance between the two clips 55, 105 is smaller than the length "L" of the cutting blade 35. The first and the second clip 55, 105 each have a portion which is in front of the cutting blade 35. The portions of the clips 55, 105 in front of the cutting blade retain the cutting blade 35. The portion of clips 55, 105 in front of the cutting blade 35 touches the cutting blade 35 when the blades are in a rest-position (i.e. when no external force is applied to the shaving blade cartridge). In addition, the clip can comprise an aluminum alloy material. The blade can comprise steel alloy material. The different materials between the blade and clip enhance cathodic protection and blade longevity.

The shape of the second clip 105 is similar to the shape of the first clip 55: the second clip 105 comprises a first leg 107, a second leg 109 and a clip body 110 extending between the first leg 107 and the second leg 109.

The first leg 107 of the second clip 105 surrounds the first longitudinal side 15. The first leg 107 of the second clip 105 can surround a second cut-out 111 arranged on the first longitudinal side 15.

In the embodiment with two clips 55, 105, the housing 9, as shown in FIGS. 1-3 and 6 comprises a second through hole 113. The second through hole 113 is similar to the previous disclosed through hole 93 (also called the first through hole 93). The second through hole is intended to receive the second leg 109 of the second clip 105. Whereas the first through hole 93 is located toward the first lateral side 19, the second through hole is located toward the second lateral side 21. The second through hole 113 extends transversally to the longitudinal axis X-X along the lateral axis Z-Z through the housing 9 between the top side 11 and the bottom side 13. The second through hole 113 is, as shown in FIGS. 1-4 and 6, separated from the blade receiving section 33 and is separated from the first through hole 93. T he distance between the first and the second through hole 93, 113 in the longitudinal direction X is less than the length L of the cutting blade 35 in the longitudinal direction X. The first through hole 93 can be arranged near the first lateral side 19 whereas the second through hole 113 can be arranged near the second lateral side 21.

The second leg 109 of the second clip 105 is received in the second through hole 113. As previously described, the second through hole 113 is arranged near the second longitudinal side 17. The first cut-out 85 is arranged at the common edge 115 of the first longitudinal side 15 and the first lateral side 19 whereas the second cut-out 111 is arranged at the common edge of the first longitudinal side 17 and the second lateral side 21.

As for the first clip 55, the second leg 109 of the second clip 105, which is received in the second through hole 113, is bent around at least a portion of the bottom side 13, as shown on FIGS. 3 and 4. The second leg 109 of the second clip 105 can extend in a groove 117 provided on the bottom side 13 of the housing 9. For example, the groove 117 for the second leg 109 of the second clip 105 is in the continuity of a groove 119 arranged in the housing 9 for the first leg 107 of the second clip 105. The groove 119 extends on the first longitudinal side 15.

The bottom side 13 of the housing 9 can include a fulcrum portion 121 (or protruding portion) arranged to receive a portion of the second leg 109 of the second clip 105 which is bent over the fulcrum portion 121.

The second end of the second clip 105, corresponding to the free end of the second leg can be tapered (preferably V-shaped).

The shaving blade cartridge 1 includes a mid-plane Pm orthogonal to the longitudinal axis X-X, as shown on FIG. 1. The mid-plane Pm extends at an equal distance between the first and second lateral sides 19, 21. The mid-plane Pm can form a symmetrical plan of the shaving blade cartridge 1.

In a first embodiment, shown on FIGS. 1-3, the first through hole 93 is arranged forward of the cutting blades 35; more precisely, the first through hole 93 is arranged in or adjacent to the guard bar 99 when it exists. The guard bar 99 is preferably at or near the second longitudinal side 17. The rear cap 101 is thus preferably at or near the first longitudinal side 15. The first leg 59 of the first clip 55 surrounds the rear cap 101.

The second through hole 113 is also arranged in or adjacent to the guard bar 99. The first leg 107 of the second clip 105 surrounds the rear cap 101.

As shown in FIGS. 1-3, the first and second cut-outs 85, 111 are then disposed at each free ends of the rear cap 101 and/or of the shaving aid member 103. In other words, between both cut-outs 85, 111 extend the rear cap 101 and/or the shaving aid member 103. The shaving aid member 103 is smaller in length than the cutting blade 35. The rear cap 101 and/or the shaving aid member 103 extends between the two clips 55, 105.

In a second embodiment, shown on FIG. 6A and FIG. 6B, the first through hole 93 is arranged rearward of the cutting blades 35; more precisely, the first through hole 93 is arranged in or adjacent to the rear cap 101 when it exists. The rear cap 101 is then preferably at or near the second longitudinal side 17. The first leg 59 of the first clip 55 surrounds the guard bar 99. The second through hole 113 is also arranged in or adjacent to the rear cap 101. The first leg 107 of the second clip 105 surrounds the rear cap 101. As shown in FIGS. 6*a* and 6*b*, the first and second cut-outs 85, 111 are then disposed at each free ends of the guard bar 99. In other words, the guard bar 99 extends between both cut-outs 85, 111. The guard bar 99 is smaller in length than the at least one cutting blade 35. The guard bar 99 extends between the two clips 55, 105. The guard bar 99 is smaller in length than the cutting blades 35.

In others embodiments (not shown), the first through hole 93 can be arranged in or adjacent to the guard bar 99, whereas the second through hole 113 is arranged in or adjacent to the rear cap 101. Thus, the second leg 61 of the first clip 55 is received in the first through hole 93 arranged in or adjacent to the guard bar 99, whereas the first leg 59 of the first clip 55 surrounds the first longitudinal side 15 provided at the rear cap 101 side. The second leg 109 of the second clip 105 is received in the second through hole 113 arranged in or adjacent to the rear cap 101, whereas the first leg 107 of the second clip 105 surrounds the first longitudinal side 15 provided at the guard bar 101 side.

The clips 55, 105 can be assembled to the housing 9 by a system for the manufacture of clip-housing assemblies with, for example, the followings steps:

providing the clip 55, 105, made of a formable material, assembling the clip 55, 105 to the housing by placing the first leg 59, 107 on the first longitudinal side 15 of the housing 9 and the second leg 61, 109 of the second longitudinal side 17 of the housing 9, deforming the first and second legs 59, 107, 61, 109 to cooperate with the bottom side 13 of the housing 9 to hold the cutting blades 35 within the housing 9 (and more precisely within the blade receiving section 33).

The first and second legs 59, 107, 61, 109 can be deformed with a bending tool comprising assembly clamps (not shown) that bend the clip legs in position.

The bottom of the housing 9 can also include a protrusion 125. The protrusion 125 extends along the longitudinal axis X-X and is provided preferably in the middle of the bottom side 13 of the housing 9. The protrusion protrudes from the bottom of the housing 9 along the lateral axis Z-Z. In a mounted position of the clip 55, the first end 37 of the clip 55 is on one side of the protrusion 125, whereas the second end 71 of the clip is on the other side of the protrusion 125. The protrusion 125 can advantageously protect the clip 55 from the assembly clamps. Indeed, in other cartridges, after the legs of the clips are bent into their mounted position by the assembly clamps, it may happen that the assembly clamps accidentally grab the ends of the clip when being moved away or removed from the blade cartridge provided with the clip, which can unbend the clip and result in scrapping the entire head. The protrusion 125 in the present invention does not allow the assembly clamps to accidently grab the clip end on their remove movement, and thus the protrusion 125 secures the position of the clip during mounting steps. The lower horizontal plane of the protrusion is in a substantially similar horizontal plane of the lower section of each leg of the clip disposed on the underside of the housing.

The invention claimed is:

1. A shaving blade cartridge comprising:

a housing extending along a longitudinal axis (X-X), having a top side, a bottom side opposite to the top side and first and second longitudinal side, each extending longitudinally along the longitudinal axis between the top and bottom side, the housing being provided with first and second through holes extending transversally to the longitudinal axis through the housing between the top side and the bottom side and a groove forming a curved surface connecting the top side and the first longitudinal side, the first longitudinal side having a cap member, the second longitudinal side having a guard bar member, and a first and second vertical side extending substantially transverse to the first and second longitudinal side, at least one cutting blade mounted in the housing between the first and second longitudinal side, and having a cutting edge extending along the longitudinal axis, at least two clips retaining the at least one cutting blade in the housing, wherein each of the two clips includes a first leg, a second leg and a clip body extending between the first and second legs, wherein the first leg of each clip is disposed in the groove in the first longitudinal side and at least a portion of the bottom side of the housing, wherein the second leg of each clip is received in the first and second through holes such that each of the at least two clips wraps around the first longitudinal side only without wrapping around the second longitudinal side, the guard bar member being forward of the at least one cutting blade extending between the at least two clips, and the cap member being aft of the at least one cutting blade extending between the at least two clips, wherein the clip body extends along a transversal axis (Y-Y), the transversal axis being orthogonal to the longitudinal axis (X-X), and wherein the clip body is arranged facing the top side of the blade cartridge, wherein the second leg of each clip is bent around at least a portion of the bottom side, wherein the first and second through holes are arranged adjacent to the guard bar member, wherein the groove in the first longitudinal side includes a first groove formed between the cap member and the first vertical side, and a second groove formed between the cap member and the second vertical side, wherein the cap member comprises a shaving aid member that is smaller in length than the at least one cutting blade and extends between the at least two clips, and the guard bar member is smaller in length than the at least one cutting blade and extends between the at least two clips, and wherein an underside of each of the clips comprises angled grooves that define angles with respect to edges of the at least one cutting blade for receiving and contacting the at least one cutting blade to ensure a more secure connection between the at least two clips and the at least one cutting blade.

2. The shaving blade cartridge according to claim 1, wherein the first leg of each of the clips comprises a hook, the bottom side of the housing comprises a recess, and the hook cooperates with the recess.

3. The shaving blade cartridge according to claim 2, wherein the bottom side includes a first fulcrum portion extending outward beyond adjacent surface portions on one side of the first fulcrum portion, and wherein one of the first and second legs of each of the clips has a portion which is bent over the first fulcrum portion.

4. The shaving blade cartridge according to claim 3, wherein the bottom side further includes a second fulcrum portions the second fulcrum portions extending outward beyond adjacent surface portions on one side of the second fulcrum portion, the first leg of each of the clips being bent over the first fulcrum portion, and the second leg of each of the clips being bent over the second fulcrum portion.

5. The shaving blade cartridge according to claim 4, wherein the housing defines a cut-out, the first leg of each of the clips surrounds the cut-out.

6. The shaving blade cartridge according to claim 1, wherein the first leg of each of the clips comprises a retaining connection adapted to cooperate with a complementary connection formed on the bottom side of the housing, both the retaining connection and the complementary connection extending beyond lateral ends of the groove and towards the first and second vertical sides.

7. A shaving blade cartridge comprising:

a housing extending along a longitudinal axis (X-X), having a top side, a bottom side opposite to the top side and first and second longitudinal side, each extending longitudinally along the longitudinal axis between the top and bottom side, the housing being provided with first and second through holes extending transversally to the longitudinal axis through the housing between the top side and the bottom side and a groove on the first longitudinal side, the first longitudinal side having a cap member, the second longitudinal side having a guard bar member, and a first and second vertical side extending substantially transverse to the first and second longitudinal side, at least one cutting blade mounted in the housing between the first and second longitudinal side, and having a cutting edge extending along the longitudinal axis, at least two clips retaining the at least one cutting blade in the housing, wherein each of the two clips includes a first leg, a second leg and a clip body extending between the first and second legs, wherein the first leg of each clip is disposed in the groove in the first longitudinal side and at least a portion of the bottom side of the housing, wherein the second leg of each clip is received in the first and second through holes, the guard bar member being forward of the at least one cutting blade extending between the at least two clips, and the cap member being aft of the at least one cutting blade extending between the at least two clips, wherein the clip body extends along a transversal axis (Y-Y), the transversal axis being orthogonal to the longitudinal axis (X-X), and wherein the clip body is arranged facing the top side of the blade cartridge, wherein the second leg of each clip is bent around at least a portion of the bottom side, wherein the first and second through holes are arranged adjacent to the guard bar member, wherein the groove in the first longitudinal side includes a first groove formed between the cap member and the first vertical side, and a second groove formed between the cap member and the second vertical side, and wherein an underside of each of the clips comprises angled grooves that define angles with respect to edges of the at least one cutting blade for receiving and contacting the at least one cutting blade to ensure a more secure connection between the at least two clips and the at least one cutting blade.

8. The shaving blade cartridge according to claim 7, wherein the cap member comprises a shaving aid member that is smaller in length than the at least one cutting blade and extends between the at least two clips, and the guard bar member is smaller in length than the at least one cutting blade and extends between the at least two clips.

9. The shaving blade cartridge according to claim 7, wherein a first distance from a first plane that cuts through a middle of the cap member and is parallel to the first longitudinal side to a second plane that cuts through the middle of the guard bar member and is parallel to the second longitudinal side is smaller than a second distance from an edge of the groove to the second plane, the first distance and the second distance being perpendicular to the second plane.

10. The shaving blade cartridge according to claim 7, wherein the first leg of each clip comprises a retaining connection adapted to cooperate with a complementary connection formed on the bottom side of the housing, both the retaining connection and the complementary connection extending beyond lateral ends of the groove and towards the first and second vertical sides.

11. The shaving blade cartridge according to claim 10, wherein the retaining connection comprises two triangular extension portions that extend beyond the lateral ends of the groove and towards the first and second vertical sides, and the complementary connection comprises a triangular groove for receiving one of the two triangular extension portions.

12. A shaving blade cartridge comprising:

a housing extending along a longitudinal axis (X-X), having a top side, a bottom side opposite to the top side and first and second longitudinal side, each extending longitudinally along the longitudinal axis between the top and bottom side, the housing being provided with first and second through holes extending transversally to the longitudinal axis through the housing between the top side and the bottom side and a groove on the first longitudinal side, the first longitudinal side having a cap member, the second longitudinal side having a guard bar member, and a first and second vertical side extending substantially transverse to the first and second longitudinal side, at least one cutting blade mounted in the housing between the first and second longitudinal side, and having a cutting edge extending along the longitudinal axis, at least two clips retaining the at least one cutting blade in the housing, wherein each of the two clips includes a first leg, a second leg and a clip body extending between the first and second legs, wherein the first leg of each clip is disposed in the groove in the first longitudinal side and at least a portion of the bottom side of the housing, wherein the second leg of each clip is received in the first and second through holes, the guard bar member being forward of the at least one cutting blade extending between the at least two clips, and the cap member being aft of the at least one cutting blade extending between the at least two clips, wherein the clip body extends along a transversal axis (Y-Y), the transversal axis being orthogonal to the longitudinal axis (X-X), and wherein the clip body is arranged facing the top side of the blade cartridge, wherein the second leg of each clip is bent around at least a portion of the bottom side, wherein the first and second through holes are arranged adjacent to the guard bar member, wherein the groove in the first longitudinal side includes a first groove formed between the cap member and the first vertical side, and a second groove formed between the cap member and the second vertical side, and wherein the first leg of each clip comprises a retaining connection adapted to cooperate with a complementary connection formed on the bottom side of the housing, both the retaining connection and the complementary connection extending beyond lateral ends of the groove and towards the first and second vertical sides, the retaining connection comprising two triangular extension portions that extend beyond the lateral ends of the groove and towards the first and second vertical sides, and the complementary connection comprising a triangular groove for receiving one of the two triangular extension portions.

13. The shaving blade cartridge according to claim 12, wherein a first distance from a first plane that cuts through a middle of the cap member and is parallel to the first longitudinal side to a second plane that cuts through the middle of the guard bar member and is parallel to the second longitudinal side is smaller than a second distance from an edge of the groove to the second plane, the first distance and the second distance being perpendicular to the second plane.

14. The shaving blade cartridge according to claim 12, wherein the cap member comprises a shaving aid member that is smaller in length than the at least one cutting blade and extends between the at least two clips, and the guard bar member is smaller in length than the at least one cutting blade and extends between the at least two clips.

15. The shaving blade cartridge according to claim 12, wherein the housing defines a cut-out, the first leg of each of the clips surrounds the cut-out.

16. A shaving blade cartridge comprising:

a housing extending along a longitudinal axis (X-X), having a top side, a bottom side opposite to the top side and first and second longitudinal side, each extending longitudinally along the longitudinal axis between the top and bottom side, the housing being provided with first and second through holes extending transversally to the longitudinal axis through the housing between the top side and the bottom side and a groove forming a curved surface connecting the top side and the first longitudinal side, the first longitudinal side having a cap member, the second longitudinal side having a guard bar member, and a first and second vertical side extending substantially transverse to the first and second longitudinal side, at least one cutting blade mounted in the housing between the first and second longitudinal side, and having a cutting edge extending along the longitudinal axis, at least two clips retaining the at least one cutting blade in the housing, wherein each of the two clips includes a first leg, a second leg and a clip body extending between the first and second legs, wherein the first leg of each clip is disposed in the groove in the first longitudinal side and at least a portion of the bottom side of the housing, wherein the second leg of each clip is received in the first and second through holes such that each of the at least two clips wraps around the first longitudinal side only without wrapping around the second longitudinal side, the guard bar member being forward of the at least one cutting blade extending between the at least two clips, and the cap member being aft of the at least one cutting blade extending between the at least two clips, wherein the clip body extends along a transversal axis (Y-Y), the transversal axis being orthogonal to the longitudinal axis (X-X), and wherein the clip body is arranged facing the top side of the blade cartridge, wherein the second leg of each clip is bent around at least a portion of the bottom side, wherein the first and second through holes are arranged adjacent to the guard bar member, wherein the groove in the first longitudinal side includes a first groove formed between the cap member and the first vertical side, and a second groove formed between the cap member and the second vertical side, wherein the cap member comprises a shaving aid member that is smaller in length than the at least one cutting blade and extends between the at least two clips, and the guard bar member is smaller in length than the at least one cutting blade and extends between the at least two clips, and wherein the first leg of each clip comprises a retaining connection adapted to cooperate with a complementary connection formed on the bottom side of the housing, both the retaining connection and the complementary connection extending beyond lateral ends of the groove and towards the first and second vertical sides, the retaining connection comprising two triangular extension portions that extend beyond the lateral ends of the groove and towards the first and second vertical sides, and the complementary connection comprising a triangular groove for receiving one of the two triangular extension portions.

17. The shaving blade cartridge according to claim 16, wherein an underside of each of the clips comprises angled grooves that define angles with respect to edges of the at least one cutting blade for receiving and contacting the at least one cutting blade to ensure a more secure connection between the at least two clips and the at least one cutting blade.

* * * * *